US006018290A

United States Patent [19]

Vande Lune et al.

[11] Patent Number: 6,018,290

[45] Date of Patent: Jan. 25, 2000

[54] APPARATUS FOR PERMITTING QUIET MANUAL SETTING OF AN APPLIANCE TIMER HAVING A BELL CHIME ASSEMBLY ASSOCIATED THEREWITH

[75] Inventors: Steven W. Vande Lune, Kendall County, Ill.; Ronald E. Cole, Johnson County; Ross G. Helft, Marion County, both of Ind.

[73] Assignee: Emerson Electric Co., St. Louis, Mo.

[21] Appl. No.: 09/041,418

[22] Filed: Mar. 12, 1998

[51] Int. Cl.[7] ..... G08B 3/10

[52] U.S. Cl. ..... 340/384.1; 340/309.15; 368/100; 368/254; 368/259; 368/260; 200/38 BA

[58] Field of Search ..... 340/309.15, 384.71; 200/38 R, 38 A, 38 B, 38 BA; 368/89, 100, 243, 244, 248, 254, 259, 260

[56] References Cited

U.S. PATENT DOCUMENTS

| | | | |
|---|---|---|---|
| 919,716 | 4/1909 | Gundorph . | |
| 2,342,327 | 2/1944 | Braun . | |
| 2,583,245 | 1/1952 | Valkenburgh et al. | 200/38 R |
| 3,960,105 | 6/1976 | Ring | 116/22 R |
| 4,001,528 | 1/1977 | Deane et al. | 200/38 R |
| 4,242,746 | 12/1980 | Schuder et al. | 368/109 |
| 4,490,589 | 12/1984 | Voland | 200/38 R |
| 4,616,209 | 10/1986 | Mahon | 340/309.15 |
| 4,867,005 | 9/1989 | Voland | 200/38 R |
| 5,745,441 | 4/1998 | Dunsbergen et al. | 368/100 |

*Primary Examiner*—Julie Lieu
*Attorney, Agent, or Firm*—Mark D. Becker

[57] ABSTRACT

A timer for controlling an appliance includes a bell chime assembly having a striker, a torsion spring, and a bell. The striker is secured to the torsion spring. The timer further includes a cam follower operatively coupled to the torsion spring. The cam follower is operatively associated with a cam assembly which includes a first cam and a second cam. The first cam and the second cam are configured such that during manual setting of the timer, the torsion spring is prevented from deflecting by an amount sufficient to cause the striker to contact the bell whereby relatively quiet manual setting of the timer is enabled.

19 Claims, 4 Drawing Sheets

APPARATUS FOR PERMITTING QUIET MANUAL SETTING OF AN APPLIANCE TIMER HAVING A BELL CHIME ASSEMBLY ASSOCIATED THEREWITH

TECHNICAL FIELD OF THE INVENTION

The present invention relates generally to timing devices, and more specifically to an apparatus for permitting quiet manual setting of an appliance timer which has a bell chime assembly associated therewith.

BACKGROUND OF THE INVENTION

Appliance timers are commonly used in many household appliances, such as clothes dryers, dishwashers, and clothes washers. The appliance timer controls operations of the appliance by actuating and deactuating switches which start and stop various work operations within the appliance such as a heated tumble operation in the case of a clothes dryer. The switches within the appliance timer are actuated and deactuated by interaction of a cam surface defined in a cam of the appliance timer and a cam follower which is associated with a particular switch.

Appliance timers typically have an audible tone generating device associated therewith. Such a device is actuated at predetermined points in time during an appliance cycle in order to alert an operator that the appliance is nearing or at the end of the cycle. Certain appliance timers which have heretofore been designed include an electric buzzer which generates a buzzing tone when actuated by the timer. For example, in the case of a clothes dryer, the buzzer is selectively actuated by the appliance timer to alert the operator that the drying cycle is nearing completion thereby alerting the operator to remove his or her clothes from the dryer in order to prevent wrinkling or the like.

In addition, it may be desirable to equip certain appliance models, such as "high-end" models, with a tone generating device which emits a more pleasant audible tone relative to electric buzzers which have heretofore been designed. For example, a number of appliance timers which have heretofore been designed include a bell chime assembly which is selectively chimed by the appliance timer at predetermined points in time during an appliance cycle.

However, use of appliance timers which include a bell chime assembly have a number of drawbacks associated therewith. For example, it is desirable to provide an appliance timer which may be manually set by the operator in a quiet manner. In particular, it is desirable to provide an appliance timer in which the bell is not chimed during a period of time in which the operator manually sets the appliance timer.

Hence, what is needed is an appliance timer which overcomes one or more of the above-mentioned drawbacks. What is further needed is an appliance timer which has an apparatus for permitting quiet manual setting of the appliance timer.

SUMMARY OF THE INVENTION

In accordance with a first embodiment of the present invention, there is provided a timer for controlling an appliance. The timer includes a bell chime assembly having a striker and a bell. The timer also includes a motor having an operating state and an idle state. The timer further includes a first cam having a first cam neutral surface and a first cam valley surface. The first cam is rotated by the motor when the motor is in the operating state, whereas the first cam is idle when the motor is in the idle state. The timer yet further includes a second cam having a second cam neutral surface, a second cam valley surface, and a strike preventing transition cam surface interposed therebetween. The second cam is rotated by the motor when the motor is in the operating state, whereas the second cam is able to be manually rotated by an operator when the motor is in the idle state. Moreover, the timer includes a cam follower which is positionable between a neutral position and a valley position. The cam follower contacts the strike preventing transition cam surface during movement of the cam follower from the neutral position to the valley position when the motor is in the idle state, whereby the striker is prevented from contacting the bell during manual rotation of the second cam by the operator when the cam follower is aligned with the first cam valley surface.

In accordance with a second embodiment of the present invention, there is provided a timer for controlling an appliance. The timer includes a bell chime assembly having a striker, a torsion spring, and a bell. The striker is secured to the torsion spring. The timer also includes a motor having an operating state and an idle state. The timer further includes a cam follower operatively coupled to the torsion spring. The cam follower is positionable between a neutral position and a valley position. The timer yet further includes a first cam having a first cam neutral surface and a first cam valley surface. The first cam is rotated by the motor when the motor is in the operating state, whereas the first cam is idle when the motor is in the idle state. Moreover, the timer includes a second cam having a second cam neutral surface, a second cam valley surface, and a strike preventing transition cam surface interposed therebetween. The second cam is rotated by the motor when the motor is in the operating state, whereas the second cam is able to be manually rotated by an operator when the motor is in the idle state. The strike preventing transition cam surface is configured such that the torsion spring is caused to deflect by a first amount when the cam follower is moved from the neutral position to the valley position via contact with the strike preventing transition cam surface. The first amount of deflection of the torsion spring is insufficient to cause contact between the striker and the bell, whereby the striker is prevented from contacting the bell during manual rotation of the second cam by the operator when the cam follower is aligned with the first cam valley surface.

In accordance with a third embodiment of the present invention, there is provided a timer for controlling an appliance. The timer includes a bell chime assembly having a striker and a bell. The timer also includes a motor having an operating state and an idle state. The timer further includes a first cam having a first cam neutral surface and a first cam valley surface. The first cam is rotated by the motor when the motor is in the operating state, whereas the first cam is idle when the motor is in the idle state. The timer yet further includes a second cam having a second cam neutral surface, a second cam valley surface, and a linearly inclined ramp surface interposed therebetween. The second cam is rotated by the motor when the motor is in the operating state, whereas the second cam is able to be manually rotated by an operator when the motor is in the idle state. Moreover, the timer includes a cam follower which is positionable between a neutral position and a valley position. The cam follower contacts the linearly inclined ramp surface during movement of the cam follower from the neutral position to the valley position when the motor is in the idle state, whereby the striker is prevented from contacting the bell during manual rotation of the second cam by the operator when the cam follower is aligned with the first cam valley surface.

It is therefore an object of the present invention to provide a new and useful timer for controlling an appliance.

It is a further object of the present invention to provide an improved timer for controlling an appliance.

It is also an object of the present invention to provide an appliance timer that may be manually set in a relatively quiet manner.

The above and other objects, features, and advantages of the present invention will become apparent from the following description and the attached drawings.

DETAILED DESCRIPTION OF THE INVENTION

Figure 1:
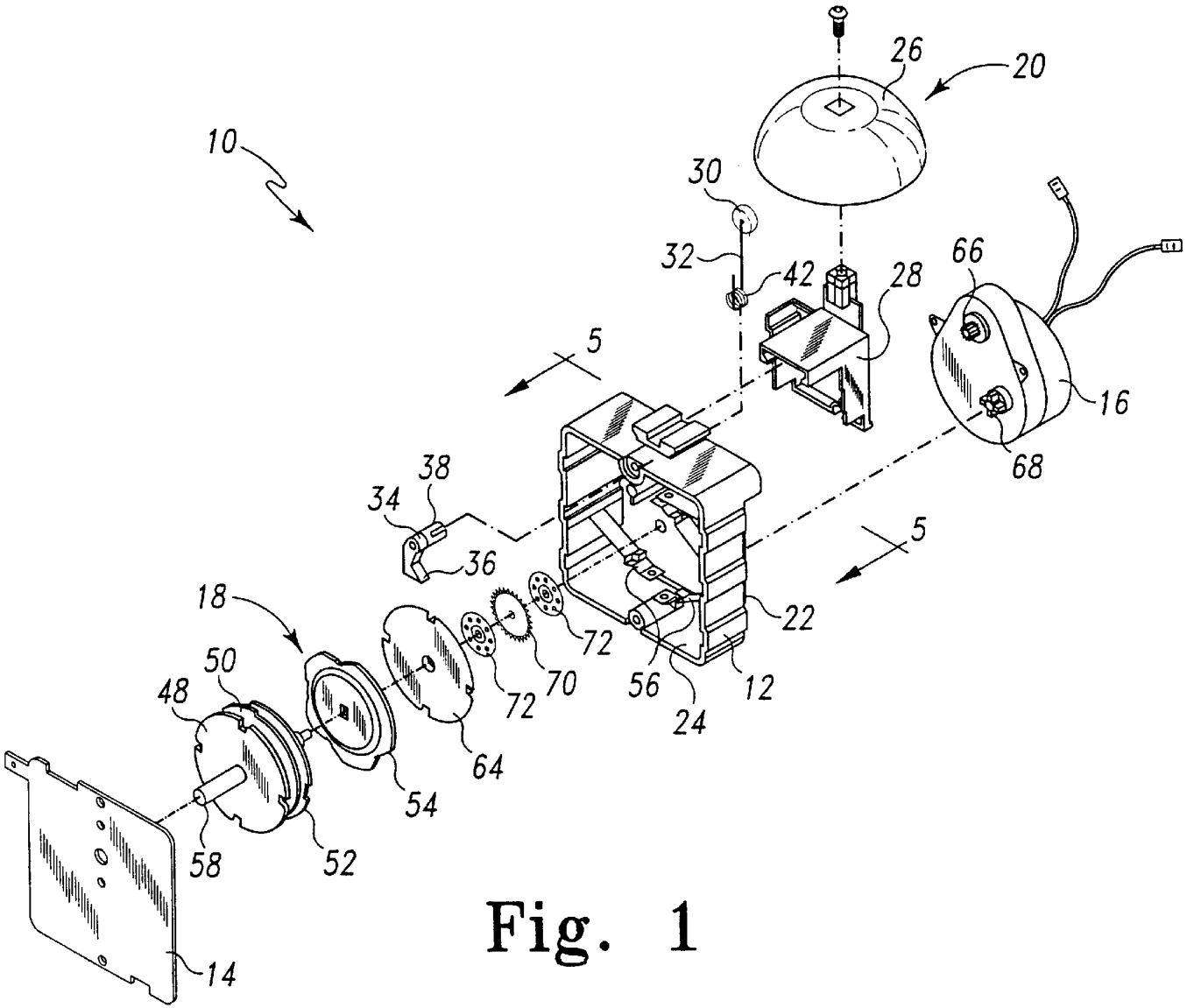
FIG. 1 is an exploded perspective view of an appliance timer which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Referring now to FIG. 1, there is shown an appliance timer 10 for controlling various work functions associated with an appliance, such as a clothes dryer (not shown). The appliance timer 10 includes a housing 12, a cover plate 14, a motor and gear train assembly 16, a cam assembly 18, and a bell chime assembly 20. As shown in FIG. 1, the motor and gear train assembly 16 and the bell chime assembly 20 are secured to an outer surface 22 of the housing 12, whereas the cam assembly 18 is positioned in an inner portion 24 of the housing 12.

The bell chime assembly 20 includes a brass bell 26 which is secured on a bell mount 28, a striker 30 secured to one end of a torsion spring 32, and an actuation lever 34. As shown in FIG. 1, the actuation lever 34 has a cam follower portion 36 and a shaft portion 38. The cam follower portion 36 is positioned within the inner portion 24 of the housing 12, whereas the shaft portion 38 extends through an aperture (not shown) defined in the housing 12. A coiled middle portion 42 of the torsion spring is concentrically mounted on the shaft portion 38 of the actuation lever 34. Movement of the of the cam follower portion 36 of the actuation lever 34 in the general direction of arrow 44 of FIGS. 5 and 6 causes the torsion spring and hence the striker 30 to be moved in the general direction of arrow 92 of FIGS. 5 and 6. Conversely, when the cam follower portion 36 of the actuation lever 34 is moved in the general direction of arrow 46 of FIGS. 5 and 6, the striker 30 is moved in the general direction of arrow 94 of FIGS. 5 and 6.

The cam assembly 18 is provided to selectively actuate a number of switch assemblies 56 included in the appliance timer 10. In particular, the cam assembly 18 includes a number of switch program cams 48, 50, and 52. The switch program cams 48, 50, and 52 cooperate with the switch assemblies 56 in order to perform a number of switching functions associated with operation of the appliance (not shown). For example, the switch program cams 48, 50, and 52 may selectively make and/or break the switch assemblies 56 in order to actuate and/or deactuate a dryer motor or a heater associated with a clothes dryer (not shown).

The cam assembly 18 also includes a chime program cam 54 which is provided to selectively chime the bell chime assembly 20. The program cams 48, 50, 52, and 54 are each non-rotatably secured to a control shaft 58. Hence, rotation of the control shaft 58 in the general direction of either arrow 60 or arrow 62 of FIGS. 5 and 6 likewise causes rotation of the program cams 48, 50, 52, and 54 in the general direction of arrows 60 and 62, respectively. The cam assembly 18 also includes a pulsar cam 64. The pulsar cam 64 is rotatably coupled to the control shaft 58. Hence, the pulsar cam 64 may rotate relative to the control shaft 58.

The program cams 48, 50, 52, and 54 and the pulsar cam 64 are driven by the motor and gear train assembly 16 when the motor thereof is in an operating state. In particular, the motor and gear train assembly 16 includes a pair of output pinions 66 and 68. The output pinion 66 is meshingly engaged with a drive gear 70 which is non-rotatably secured to the control shaft 58 by a pair of spring washers 72. Hence, rotation of the output pinion 66 causes the drive gear 70 and therefore the program cams 48, 50, 52, and 54 to be likewise rotated. The output pinion 68 on the other hand is meshingly engaged with a number of gear teeth 74 defined in the pulsar cam 64. Hence, rotation of the output pinion 68 causes rotation of the pulsar cam 64 (see FIG. 3). It should be appreciated that the when the motor and gear train assembly 16 is in an idle state, the program cams 48, 50, 52, and 54 and the pulsar cam 64 are likewise idle. As shall be discussed below in more detail, the appliance timer 10 may be manually set by an operator (not shown) when the motor and gear train assembly 16 is in the idle state. It should be noted that the motor and gear train assembly 16 is in the idle state when no voltage is being applied across the terminals of the motor.

The program cams 48, 50, 52, and 54 are driven at a speed which is different in magnitude than the speed at which the pulsar cam 64 is driven. In particular, the output speed of the output pinions 66, 68 is predetermined such that the program cams 48, 50, 52, and 54 are driven at a speed which is slower than the speed at which the pulsar cam 64 is driven. For example, the program cams 48, 50, 52, and 54 may be driven at a rotational speed of 0.005 revolutions-per-minute, whereas the pulsar cam 64 may be driven at a speed of 1.0 revolutions-per-minute. Moreover, it should be appreciated that the program cams 48, 50, 52, and 54 are driven by the motor and gear train assembly 16 in a direction which is opposite to the direction in which the pulsar cam 64 is driven. For example, the output pinion 66 of the motor and gear train assembly 16 drives the program cams 48, 50, 52, and 54 in the general direction of arrow 60 of FIGS. 5 and 6, whereas the output pinion 68 of the motor and gear train assembly 16 drives the pulsar cam 64 in the general direction of arrow 62 of FIGS. 5 and 6.

Figure 2:
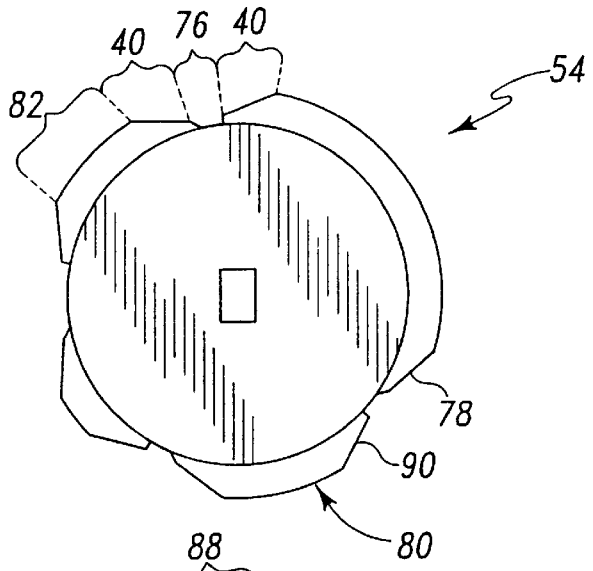
FIG. 2 is a front elevational view of the chime program cam of the appliance timer of FIG. 1.
Figure 3:
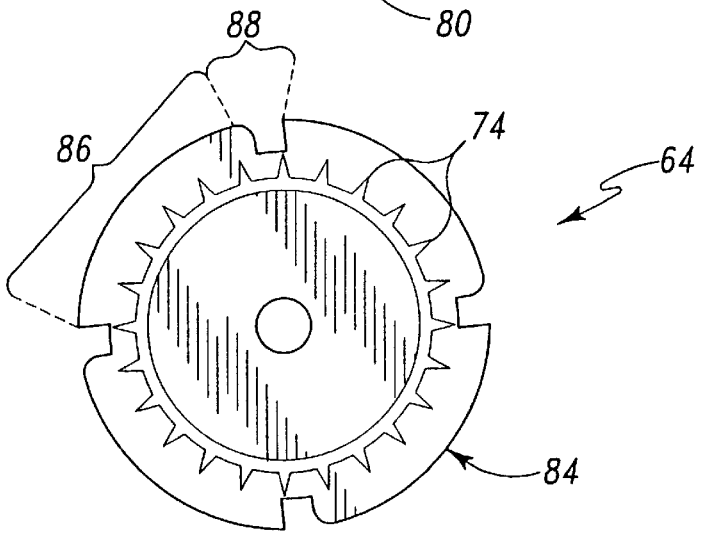
FIG. 3 is a front elevational view of the pulsar cam of the appliance timer of FIG. 1.

In addition to making and/or breaking the switch assemblies 56, the cam assembly 18 also selectively chimes the bell chime assembly 20. In particular, the chime program cam 54 cooperates with the pulsar cam 64 in order to selectively lift or drop the cam follower portion 36 of the actuation lever 34. More specifically, as shown in FIG. 2, the chime program cam 54 has a cam surface 80 defined therein which includes a neutral surface 82, a number of cam valleys 76, and a number of strike preventing transition cam surfaces 40. What is meant herein by the term "strike preventing transition cam surface" is a cam surface which is configured so as to gradually lower or raise the cam follower portion 36 of the actuation lever 34 during rotation of the chime program cam 54 without causing the striker 30 to strike or otherwise contact the bell 26. In particular, each of the strike preventing cam surfaces 40 includes a number of linearly inclined ramped surfaces 78, 90. As shown in FIG. 3, the linearly inclined ramp surfaces 78, 90 are positioned adjacent to the cam valleys 76 thereby gradually increasing or decreasing the radius of the cam surface 80 from/to the cam valleys 76 to/from the neutral surface 82.

Figure 4:
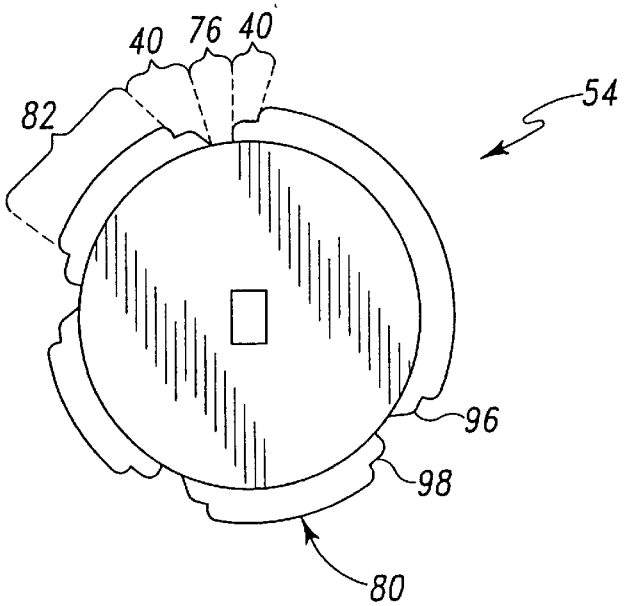
FIG. 4 is a view similar to FIG. 2, but showing a second embodiment of the chime program cam.

It should be appreciated that although the strike preventing cam surfaces 40 are herein described as including the linearly inclined ramp surfaces 78, 90 and have significant advantages thereby in the present invention, certain of these advantages may be achieved by use of other configurations in lieu of the linearly inclined ramp surfaces 78, 90. For example, as shown in FIG. 4, the strike preventing cam surfaces 40 of the chime program cam 54 may be configured to include step surfaces 96, 98.

Figure 5:
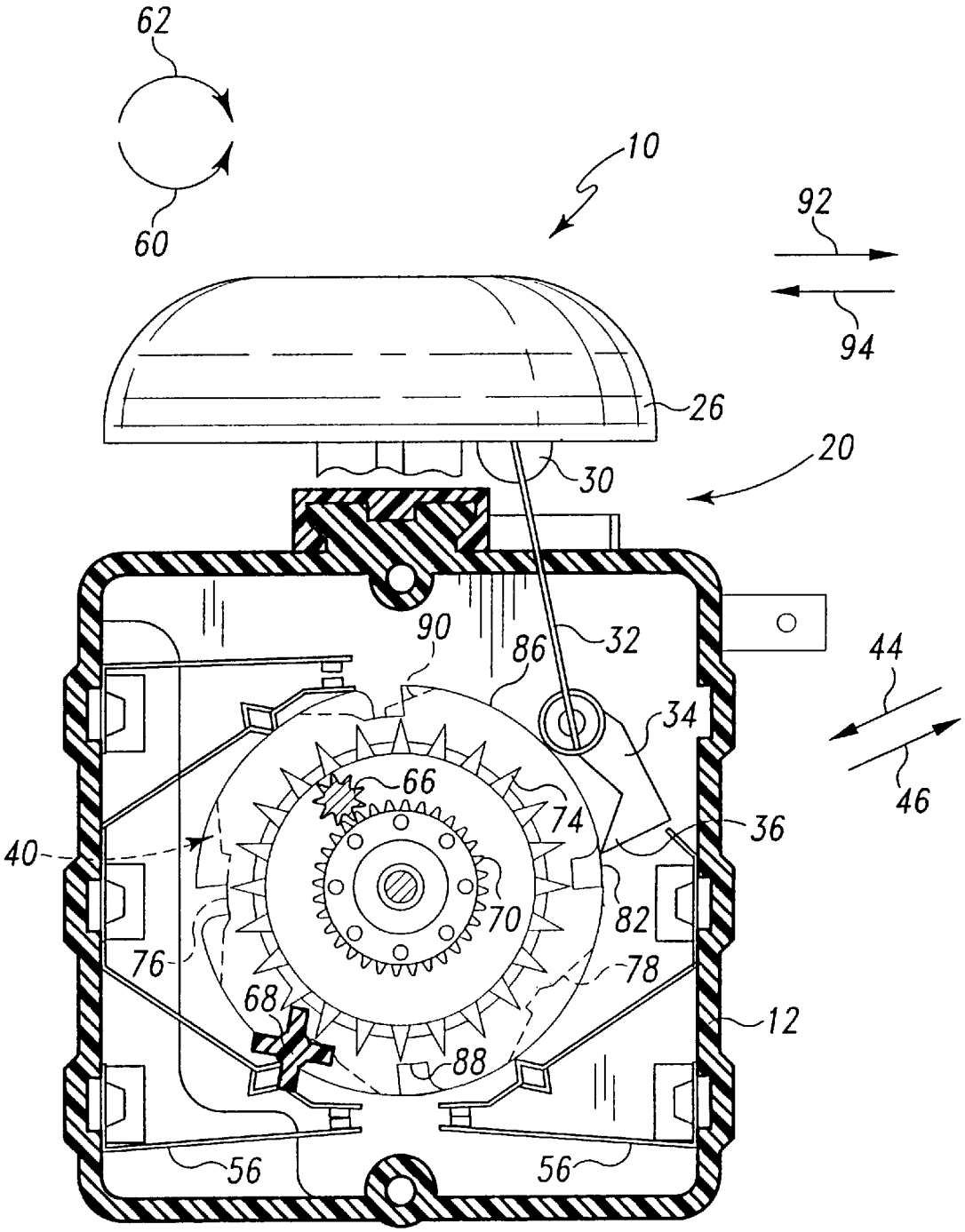
FIG. 5 is a view, partially in cross section, taken along the lines 5—5 of FIG. 1 which shows the chime program cam and the pulsar cam positioned such that the striker is spaced apart from the bell.

The pulsar cam 64 has a cam surface 84 having a neutral surface 86 and a number of cam valleys 88 defined therein (see FIG. 3). The chime program cam 54 is positioned relative the pulsar cam 64 such that the cam surface 80 of the chime program cam 54 abuts or is otherwise positioned adjacent to the cam surface 84 of the pulsar cam 64. Hence, the cam surface 80 of the chime program cam 54 and the cam surface 84 of the pulsar cam 64 cooperate to control movement of the cam follower portion 36 of the actuation lever 34. More specifically, if either the neutral surface 82 of the chime program cam 54 or the neutral surface 86 of the pulsar cam 64 is positioned so as to be located under or otherwise aligned with the cam follower portion 36 of the actuation lever 34, the actuation lever 34 is positioned in a neutral position thereby causing the striker 30 to be positioned in a first position in which the striker 30 is spaced apart from the bell 26 by a first distance as shown in FIG. 5. However, if the chime program cam 54 and the pulsar cam 64 are positioned such that one of the cam valleys 76 of the chime program cam 54 and one of the cam valleys 88 of the pulsar cam 64 are simultaneously positioned under or otherwise aligned with the cam follower portion 36 of the actuation lever 34, the actuation lever 34 is positioned in a valley position in which the cam follower portion 36 thereof is positioned in the cam valleys 76 and 88 thereby positioning the striker 30 in a second position in which the striker 30 is spaced apart from the bell 26 by a second distance as shown in solid lines in FIG. 6. If the actuation lever 34 is abruptly dropped into the cam valleys 76 and 88 without contacting the linearly inclined ramp surfaces 78, 90, the striker 30 will be urged in the general direction of arrow 92 such that the torsion spring 32 will deflect or otherwise bow beyond its second position by an amount sufficient to cause the striker 30 to contact the bell 26 as shown in phantom in FIG. 6. Thereafter, the torsion spring 32 straightens (i.e. is no longer deflected) thereby positioning the striker 30 in its second position as shown in solid lines in FIG. 6. It should be appreciated that when the striker 30 makes such contact with the bell 26, a chime is emitted from the bell chime assembly 20.

The configuration of the cam surfaces 80, 84 allows for manual setting of the appliance timer 10 without actuation (i.e. chiming or ringing) of the bell chime assembly 20. In particular, when an operator of the appliance turns or otherwise rotates a knob (not shown) coupled to the control shaft 58 in the general direction of arrow 60 of FIGS. 5 and 6 in order to manually set the appliance timer 10, the cam follower portion 36 of the actuation lever 34 is advanced along the neutral surface 82 and thereafter gradually advanced down the linearly inclined ramp surface 78, across the cam valley 76, and then gradually back up the linearly inclined ramp surface 90. Similarly, when the operator of the appliance turns or otherwise rotates the knob and hence the control shaft 58 in the general direction of arrow 62 of FIGS. 5 and 6 in order to manually set the appliance timer 10, the cam follower portion 36 of the actuation lever 34 is advanced along the neutral surface 82 and thereafter gradually advanced down the linearly inclined ramp surface 90, across the cam valley 76, and then gradually back up the linearly inclined ramp surface 78. It should be appreciated that such gradual advancement of the cam follower portion 36 of the actuation lever 34 up and/or down the linearly inclined ramp surfaces 78, 90 prevents the cam follower portion 36 from being abruptly dropped into the cam valleys 76, 88 thereby moving the actuation lever 34 into and out of its valley position in a manner which causes the torsion spring 32 to deflect or otherwise bow an amount which is less than the amount required to cause the striker 30 to strike the bell 26. In particular, such gradual advancement of the actuation lever 34 between its neutral position and its valley position causes the striker 30 to be positioned in its second position during the periods of time in which the actuation lever 34 is positioned in its valley position, as shown in solid lines in FIG. 6, but does not cause the torsion spring 32 to deflect or otherwise bow an amount necessary to cause the striker 30 to strike the bell 26. Hence, during manual setting of the appliance timer 10, the striker 30 is prevented from striking the bell 26 thereby preventing a chime from being emitted from the bell chime assembly 20.

It should also be appreciated that the cam follower portion 36 of the actuation lever 34 does not advance along the linearly inclined ramp surfaces 78, 90 in the manner described above unless the pulsar cam 64 is positioned such that one of the cam valleys 88 thereof is located under or otherwise aligned with the cam follower portion 36. In particular, if the pulsar cam 64 is positioned such that the neutral surface 86 thereof is located under or otherwise aligned with the cam follower portion 36, the cam follower portion 36 and hence the actuation lever 34 is prevented from dropping into the cam valleys 76, 88 thereby positioning the striker 30 in its first position in which the striker 30 is prevented from striking the bell 26.

Figure 6:
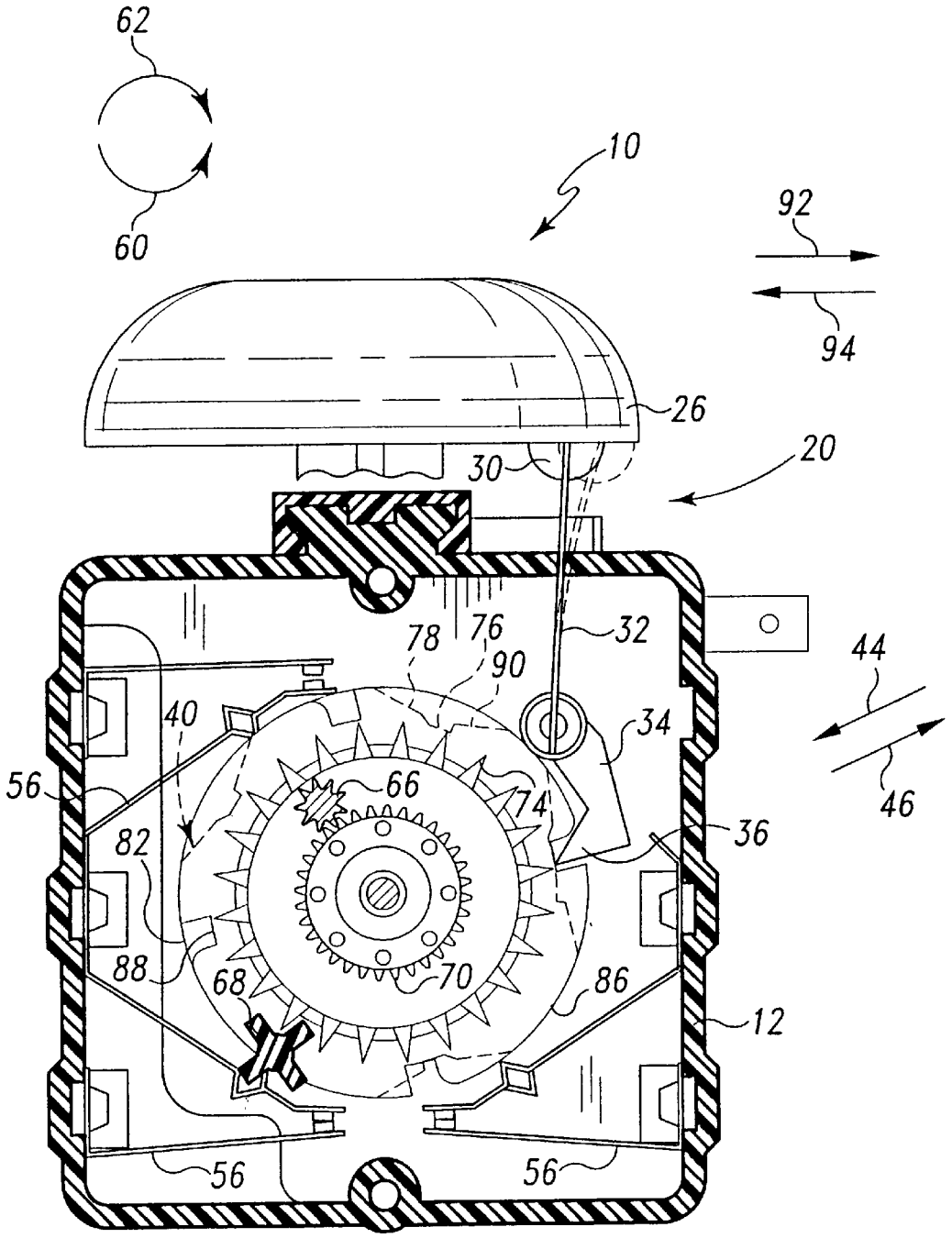
FIG. 6 is a view similar to FIG. 5, but showing the chime program cam and the pulsar cam positioned such that the striker is caused to contact the bell.

In operation, when the motor and gear train assembly 16 is in the operating state, the output pinion 66 drives the drive gear 70 and hence the program cams 48, 50, 52, and 54 in the general direction of arrow 60 of FIGS. 5 and 6 at a rotational speed of 0.005 revolutions-per-minute. As the program cams 48, 50, 52, and 54 are rotated in such a manner, the switch assemblies 56 are selectively actuated by the cam surfaces defined in the switch program cams 48, 50, and 52 so as to cause various work functions associated with the appliance to be performed such as heater and tumbler motor operation. Simultaneously, the output pinion 68 drives the pulsar cam 64 in the general direction of arrow 62 of FIGS. 5 and 6 at a rotational speed of 1.0 revolutions-per-minute.

During such rotation of the chime program cam 54 and the pulsar cam 64, if either the neutral surface 82 of the chime program cam 54 or the neutral surface 86 of the pulsar cam 64 is positioned so as to be located under or otherwise aligned with the cam follower portion 36 of the actuation lever 34, the actuation lever 34 is positioned in its neutral position thereby causing the striker 30 to be positioned in its first position in which the striker 30 is spaced apart from the bell 26 by the first distance as shown in FIG. 5. However, if the chime program cam 54 and the pulsar cam 64 are positioned such that one of the cam valleys 76 of the chime program cam 54 and one of the cam valleys 88 of the pulsar cam 64 are simultaneously positioned under or otherwise aligned with the cam follower portion 36 of the actuation lever 34, the actuation lever 34 will abruptly drop to its valley position in which the cam follower portion 36 is positioned in the cam valleys 76 and 88 thereby causing the striker 30 to be urged in the general direction of arrow 92 of FIGS. 5 and 6. It should be appreciated that when the actuation lever 34 is abruptly dropped into the cam valleys 76 and 88 without contacting the linearly inclined ramp surfaces 78, 90, the striker 30 will be urged in the general direction of arrow 92 such that the torsion spring 32 will deflect or otherwise bow beyond its second position by an amount sufficient to cause the striker 30 to contact the bell 26 as shown in phantom in FIG. 6. Thereafter, the torsion spring 32 straightens (i.e. is no longer deflected) thereby positioning the striker 30 in its second position as shown in solid lines in FIG. 6. It should be appreciated that when the striker 30 makes such contact with the bell 26, a chime is emitted from the bell chime assembly 20 thereby alerting the operator that the appliance (not shown) is nearing or at the end of a given appliance cycle.

If the operator of the appliance desires to manually set the appliance timer 10 when the motor and gear train assembly 16 is in the idle state, he or she rotates or otherwise turns the knob (not shown) coupled to the control shaft 58 in either the general direction of arrow 60 and/or arrow 62 of FIGS. 5 and 6. It should be appreciated that such rotation of the control shaft 58 causes the program cams 48, 50, 52, and 54 to be likewise rotated in the general direction of arrows 60 and/or 62, respectively. Moreover, it should further be appreciated that the pulsar cam 64 is idle (i.e. not moving) during such manual setting of the appliance timer 10 since the motor and gear train assembly 16 is not causing pinion 68 to be rotated. Hence, the pulsar cam 64 maintains the position at which it was previously located by the output pinion 68 prior to the manual setting of the appliance timer 10.

If prior to manually setting the appliance timer 10 the pulsar cam 64 is positioned such that the neutral surface 86 thereof is located under or otherwise aligned with the cam follower portion 36 of the actuation lever 34, the bell chime assembly 20 is prevented from emitting a chime therefrom. This is true since contact with the neutral surface 86 of the pulsar cam 64 prevents the cam follower portion 36 and hence the actuation lever 34 from dropping into one of the cam valleys 76 associated with the chime program cam 54.

Moreover, if prior to manually setting the appliance timer 10 the pulsar cam 64 is positioned such that one of the cam valleys 88 defined therein is located under or otherwise aligned with the cam follower portion 36 of the actuation lever 34, the cam follower portion 36 will follow the cam surface 80 defined in the chime program cam 54 during manual rotation thereof. In particular, if the operator of the appliance turns or otherwise rotates the knob and hence the control shaft 58 in the general direction of arrow 60 of FIGS. 5 and 6 in order to manually set the appliance timer 10, the cam follower portion 36 of the actuation lever 34 is advanced along the neutral surface 82 and thereafter gradually advanced down the linearly inclined ramp surface 78, across the cam valley 76, and then gradually back up the linearly inclined ramp surface 90 to the neutral surface 82. Similarly, if the operator of the appliance turns or otherwise rotates the knob and hence the control shaft 58 in the general direction of arrow 62 of FIGS. 5 and 6 in order to manually set the appliance timer 10, the cam follower portion 36 of the actuation lever 34 is advanced along the neutral surface 82 and thereafter gradually advanced down the linearly inclined ramp surface 90, across the cam valley 76, and then gradually back up the linearly inclined ramp surface 78 to the neutral surface 82. It should be appreciated that such gradual advancement of the cam follower portion 36 of the actuation lever 34 up and/or down the linearly inclined ramp surfaces 78, 90 prevents the cam follower portion 36 from being abruptly dropped into the cam valleys 76, 88 thereby moving the actuation lever 34 into and out of its valley position in a manner which causes the torsion spring 32 to deflect or otherwise bow an amount which is less than the amount required to cause the striker 30 to strike the bell 26. In particular, such gradual advancement of the actuation lever 34 between its neutral position and its valley position causes the striker 30 to be positioned in its second position during the periods of time in which the actuation lever 34 is positioned in its valley position, as shown in solid lines in FIG. 6, but does not cause the torsion spring 32 to deflect or otherwise bow an amount necessary to cause the striker 30 to strike the bell 26. Hence, during manual setting of the appliance timer 10, the striker 30 is prevented from striking the bell 26 thereby preventing a chime from being emitted from the bell chime assembly 20.

It should therefore be appreciated from the above description that the appliance timer 10 has a number of advantages relative to appliance timers which have heretofore been designed. For example, the appliance timer 10 may be manually set by the operator of the appliance in a quiet manner. In particular, during manual setting of the appliance timer 10, the configuration of the cam surfaces 80, 84 respectively defined in the chime program cam 54 and the pulsar cam 64 prevents the bell chime assembly 20 from emitting a chime therefrom.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. A timer for controlling an appliance, comprising:

a bell chime assembly having a striker and a bell;

a motor having an operating state and an idle state;

a first cam having a first cam neutral surface and a first cam valley surface, wherein (i) said first cam is rotated by said motor when said motor is in said operating state, (ii) said first cam is idle when said motor is in said idle state;

a second cam having a second cam neutral surface, a second cam valley surface, and a strike preventing transition cam surface interposed therebetween, wherein (i) said second cam is rotated by said motor when said motor is in said operating state, and (ii) said second cam is able to be manually rotated by an operator when said motor is in said idle state; and a cam follower which is positionable between a neutral position and a valley position, wherein said cam follower contacts said strike preventing transition cam surface during movement of said cam follower from said neutral position to said valley position when said motor is in said idle state, whereby said striker is prevented from contacting said bell during manual rotation of said second cam by said operator when said cam follower is aligned with said first cam valley surface.

2. The timer of claim 1, wherein:

said strike preventing transition cam surface includes a linearly inclined ramp surface which is interposed between said second cam neutral surface and said second cam valley surface, and said cam follower contacts said linearly inclined ramp surface during movement of said cam follower from said neutral position to said valley position when (i) said cam follower is aligned with said first cam valley surface, and (ii) said motor is in said idle state.

3. The timer of claim 1, wherein said cam follower contacts said first cam neutral surface so as to position said cam follower in said neutral position when said motor is in said idle state, whereby said striker is prevented from contacting said bell during manual rotation of said second cam by said operator when said cam follower is aligned with said first cam neutral surface.

4. The timer of claim 1, further comprising:

a number of switch cams;

a number of switch assemblies operatively associated with said switch cams; and a control shaft, wherein (i) said switch cams and said second cam are non-rotatably coupled to said control shaft, and (ii) manual rotation of said control shaft by said operator causes rotation of each of said switch cams and said second cam.

5. The timer of claim 1, wherein:

said bell chime assembly further comprises an actuation lever and a torsion spring, said cam follower is secured to said actuation lever, said actuation lever is secured to a first portion of said torsion spring, said striker is secured to a second portion of said torsion spring, and movement of said cam follower between said neutral position and said valley position causes movement of each of said actuation lever, said torsion spring, and said striker.

6. The timer of claim 1, wherein:

said bell chime assembly further comprises a torsion spring, said striker is secured to said torsion spring, said torsion spring is caused to deflect by a first amount when said cam follower is moved from said neutral position to said valley position via contact with said strike preventing transition cam surface, and said first amount of deflection of said torsion spring is insufficient to cause contact between said striker and said bell.

7. The timer of claim 6, wherein:

said torsion spring is caused to deflect by a second amount when said cam follower drops from said neutral position to said valley position without contacting said strike preventing transition cam surface, and said second amount of deflection of said torsion spring is sufficient to cause contact between said striker and said bell.

8. A timer for controlling an appliance, comprising:

a bell chime assembly having (i) a striker, (ii) a torsion spring, and (iii) a bell, wherein said striker is secured to said torsion spring;

a motor having an operating state and an idle state;

a cam follower operatively coupled to said torsion spring, said cam follower being positionable between a neutral position and a valley position;

a first cam having a first cam neutral surface and a first cam valley surface, wherein (i) said first cam is rotated by said motor when said motor is in said operating state, (ii) said first cam is idle when said motor is in said idle state;

a second cam having a second cam neutral surface, a second cam valley surface, and a strike preventing transition cam surface interposed therebetween, wherein (i) said second cam is rotated by said motor when said motor is in said operating state, and (ii) said second cam is able to be manually rotated by an operator when said motor is in said idle state, wherein (i) said strike preventing transition cam surface is configured such that said torsion spring is caused to deflect by a first amount when said cam follower is moved from said neutral position to said valley position via contact with said strike preventing transition cam surface, and (ii) said first amount of deflection of said torsion spring is insufficient to cause contact between said striker and said bell, whereby said striker is prevented from contacting said bell during manual rotation of said second cam by said operator when said cam follower is aligned with said first cam valley surface.

9. The timer of claim 8, wherein:

said strike preventing transition cam surface includes a linearly inclined ramp surface which is interposed between said second cam neutral surface and said second cam valley surface, and said cam follower contacts said linearly inclined ramp surface during movement of said cam follower from said neutral position to said valley position when (i) said cam follower is aligned with said first cam valley surface, and (ii) said motor is in said idle state.

10. The timer of claim 8, wherein said cam follower contacts said first cam neutral surface so as to position said cam follower in said neutral position when said motor is in said idle state, whereby said striker is prevented from contacting said bell during manual rotation of said second cam by said operator when said cam follower is aligned with said first cam neutral surface.

11. The timer of claim 8, further comprising:

a number of switch cams, a number of switch assemblies operatively associated with said switch cams; and a control shaft;

wherein (i) said switch cams and said second cam are non-rotatably coupled to said control shaft, and (ii) manual rotation of said control shaft by said operator causes rotation of each of said switch cams and said second cam.

12. The timer of claim 8, wherein:

said bell chime assembly further comprises an actuation lever and a torsion spring, said cam follower is secured to said actuation lever, said actuation lever is secured to a first portion of said torsion spring, said striker is secured to a second portion of said torsion spring, and movement of said cam follower between said neutral position and said valley position causes movement of each of said actuation lever, said torsion spring, and said striker.

13. The timer of claim 8, wherein:

said torsion spring is caused to deflect by a second amount when said cam follower drops from said neutral position to said valley position without contacting said strike preventing transition cam surface, and said second amount of deflection of said torsion spring is sufficient to cause contact between said striker and said bell.

14. A timer for controlling an appliance, comprising:

a bell chime assembly having a striker and a bell;

a motor having an operating state and an idle state;

a first cam having a first cam neutral surface and a first cam valley surface, wherein (i) said first cam is rotated by said motor when said motor is in said operating state, (ii) said first cam is idle when said motor is in said idle state;

a second cam having a second cam neutral surface, a second cam valley surface, and a linearly inclined ramp surface interposed therebetween, wherein (i) said second cam is rotated by said motor when said motor is in said operating state, and (ii) said second cam is able to be manually rotated by an operator when said motor is in said idle state; and a cam follower which is positionable between a neutral position and a valley position, wherein said cam follower contacts said linearly inclined ramp surface during movement of said cam follower from said neutral position to said valley position when said motor is in said idle state, whereby said striker is prevented from contacting said bell during manual rotation of said second cam by said operator when said cam follower is aligned with said first cam valley surface.

15. The timer of claim 14, wherein said cam follower contacts said first cam neutral surface so as to position said cam follower in said neutral position when said motor is in said idle state, whereby said striker is prevented from contacting said bell during manual rotation of said second cam by said operator when said cam follower is aligned with said first cam neutral surface.

16. The timer of claim 14, further comprising:

a number of switch cams, a number of switch assemblies operatively associated with said switch cams; and a control shaft;

wherein (i) said switch cams and said second cam are non-rotatably coupled to said control shaft, and (ii) manual rotation of said control shaft by said operator causes rotation of each of said switch cams and said second cam.

17. The timer of claim 14, wherein:

said bell chime assembly further comprises an actuation lever and a torsion spring, said cam follower is secured to said actuation lever, said actuation lever is secured to a first portion of said torsion spring, said striker is secured to a second portion of said torsion spring, and movement of said cam follower between said neutral position and said valley position causes movement of each of said actuation lever, said torsion spring, and said striker.

18. The timer of claim 14, wherein:

said bell chime assembly further comprises a torsion spring, said striker is secured to said torsion spring, said torsion spring is caused to deflect by a first amount when said cam follower is moved from said neutral position to said valley position via contact with said linearly inclined ramp surface, and said first amount of deflection of said torsion spring is insufficient to cause contact between said striker and said bell.

19. The timer of claim 18, wherein:

said torsion spring is caused to deflect by a second amount when said cam follower drops from said neutral position to said valley position without contacting said linearly inclined ramp surface, and said second amount of deflection of said torsion spring is sufficient to cause contact between said striker and said bell.

* * * * *